United States Patent [19]

Milgram

[11] 4,456,071

[45] Jun. 26, 1984

[54] OIL COLLECTOR FOR SUBSEA BLOWOUTS

[75] Inventor: Jerome H. Milgram, Brookline, Mass.

[73] Assignee: Massachusetts Institute of Technology, Cambridge, Mass.

[21] Appl. No.: 312,117

[22] Filed: Oct. 16, 1981

[51] Int. Cl.[3] ..... E21B 43/01

[52] U.S. Cl. ..... 166/356; 166/364; 166/367

[58] Field of Search ..... 166/356, 364, 367, 368, 166/369, 381, 386, 357, 79, 351; 175/5, 7; 405/60, 64, 65

[56] References Cited

U.S. PATENT DOCUMENTS

| | | | |
|---|---|---|---|
| 739,377 | 9/1903 | Bell . | |
| 1,830,061 | 11/1931 | Howe . | |
| 1,858,241 | 5/1932 | Giles . | |
| 1,859,606 | 5/1932 | Sievern et al. . | |
| 2,112,845 | 4/1938 | Howell | 166/1 |
| 2,479,787 | 8/1949 | Stevens | 23/230 |
| 3,211,223 | 10/1965 | Hoch | 166/66.5 |
| 3,312,069 | 4/1967 | Jorda | 61/1 |
| 3,389,559 | 6/1968 | Logan | 61/1 |
| 3,429,128 | 2/1969 | Stafford et al. | 61/46.5 |
| 3,469,402 | 9/1969 | Lowd | 61/1 |
| 3,500,841 | 3/1970 | Logan | 137/1 |
| 3,535,884 | 10/1970 | Chaney | 61/46.5 |
| 3,548,605 | 12/1970 | Paull et al. | 61/69 |
| 3,554,290 | 1/1971 | Verdin | 169/2 |
| 3,599,434 | 8/1971 | Missad | 61/46 |
| 3,610,194 | 10/1971 | Siegel | 114/0.5 |
| 3,643,447 | 2/1972 | Pogonowski | 61/46 |
| 3,643,741 | 2/1972 | Miranda | 166/295 |
| 3,653,215 | 4/1972 | Crucet | 61/1 |
| 3,658,181 | 4/1972 | Blair | 210/170 |
| 3,664,136 | 5/1972 | Laval, Jr. et al. | 61/1 |
| 3,665,721 | 5/1972 | Wyllie | 61/46 |
| 3,681,923 | 8/1972 | Hyde | 61/1 |
| 3,695,047 | 10/1972 | Pogonowski et al. | 61/46.5 |
| 3,719,048 | 3/1973 | Arne et al. | 61/46.5 |
| 3,745,773 | 7/1973 | Cunningham | 61/46 |
| 3,762,548 | 10/1973 | McCabe | 210/170 |
| 3,779,024 | 12/1973 | Greve | 61/46 |
| 3,813,887 | 6/1974 | Kruger et al. | 61/69 R |
| 3,855,806 | 12/1974 | Le Therisien | 166/356 X |
| 3,879,951 | 4/1975 | Mason | 61/1 R |
| 3,943,724 | 3/1976 | Banzoli et al. | 61/46.5 |
| 3,981,154 | 9/1976 | Hix, Jr. | 61/101 |
| 4,283,159 | 8/1981 | Johnson et al. | 405/60 |
| 4,318,442 | 3/1982 | Lunde et al. | 405/60 X |
| 4,358,218 | 11/1982 | Graham | 405/60 |

OTHER PUBLICATIONS

PCT/NO80/00034, Ostlund, Published May 14, 1981.

*Primary Examiner*—Ernest R. Purser
*Assistant Examiner*—Thuy M. Bui
*Attorney, Agent, or Firm*—Arthur A. Smith, Jr.; John N. Williams

[57] ABSTRACT

A collector apparatus and collection method for use with a blown-out seabottom wellhead. The collector apparatus, including a collector element with an extended, open base and an upper portion enclosing a volume to receive fluid (substantial quantities of gas and lesser quantities of oil) rising, in the water, from the wellhead, and a riser connected to the collector element and extending thereabove to conduct fluid therefrom, is characterized in that the collector element is adapted for fixable attachment to the ocean floor about the seabottom well head prior to any blow-out, and the upper portion of the collector element further includes a relief passage from its interior to the exterior of the collector apparatus, the release passage adapted to vent excess gas from the collector apparatus during initial stages of any blow-out. In preferred embodiments, the relief passage is valved to allow the passage to be closed after the initial stages of any blow-out to limit escape of released oil and reduce the amount of water collected and the collector includes a drilling port adapted to allow drilling operations to proceed therethrough.

7 Claims, 7 Drawing Figures

NORMAL DRILLING

- WATER FILLED COLLECTOR
- NO GAS OR OIL ESCAPE FROM WELLHEAD
- RELIEF VALVE 35 OPEN

BLOWOUT

- RELIEF VALVE 35 OPEN

- SUBSTANTIAL GAS ESCAPE VIA OPEN RELIEF PASSAGE 34 AND RISER 40

- LITTLE GAS LIFT PUMPING THROUGH RISER 40

COLLECTION

- RELIEF VALVE 35 CLOSED, NO WATER ENTERING
- GAS LIFT PUMPING IN RISER 40 TO COLLECT GAS AND OIL

OIL COLLECTOR FOR SUBSEA BLOWOUTS

The Government has rights in this invention pursuant to Contract Number 14-08-0001-18611 awarded by the U.S. Department of the Interior/Geological Survey.

BACKGROUND OF THE INVENTION

This invention relates to a device for collecting hydrocarbon fluids escaping from a seabottom wellhead blow-out, i.e. an uncontrolled eruption.

Blowouts from subsea wells usually contain oil, gas and water. Upon reaching the surface the gas either burns or escapes to the atmosphere. However, even if there is a surface fire, most of the liquid hydrocarbon remains unburned and causes marine pollution. Several technologies have been developed for dealing with the surface oil to try to minimize pollution, with varying degrees of success.

Two attempts at subsurface collection have taken place. At the Santa Barbara blowout of about 10 years ago, an umbrella shaped fabric device was placed near the surface to collect oil that rose into it. The oil was then pumped out of the top of the umbrella.

The second attempt was made at the IXTOC well in Campeche Bay in 1979. In this case an inverted steel cone was installed above the well head with the cone below the ocean surface. The device was supported on a cantilever truss from a fixed platform on the ocean surface. Any oil and gas that were collected were conducted to the surface through a marine riser by means of the gas-lift process, i.e. the buoyancy of the gas provided the pumping force.

SUMMARY OF THE INVENTION

This invention relates to a collector apparatus for use with a blown-out seabottom wellhead, including a collector element with an extended, open base and an upper portion enclosing a volume to receive fluid (substantial quantities of gas and lesser quantities of oil) rising, in the water, from the wellhead, and a conduit-defining riser connected to the collector element and extending above the collector element to conduct the fluid from it.

According to the invention, the collector element is adapted for fixable attachment to the ocean floor about the seabottom wellhead prior to any blow-out, and the upper portion of the collector element further includes a relief passage from its interior to the exterior of the collector apparatus which is adapted to vent excess gas from the collector apparatus during initial stages of any blow-out.

In preferred embodiments, the relief passage is valved, and thereby is adapted to remain open during drilling and during initial stages of any blow-out to allow, in the event of blow-out, escape of substantial excess volumes of gas that inherently flow from a blown out well during initial stages of blow out, and is also adapted to be closed after gas lift pumping of oil is established through the conduit-defining riser by flowing gas to limit escape of released oil from the collector element and reduce the amount of water carried through the riser by gas flow; and the collector apparatus includes a drilling port permitting passage therethrough of well drilling means to allow well drilling operations to continue through the collector apparatus while it is in place about the seabottom wellhead.

In some embodiments, the drilling port is valved and thereby is adapted to remain open while the drill string is in place and is also adapted to be closed when the drill string is removed, as during a blow out, to prevent escape of excess gas or oil. In other embodiments the drilling port is adapted to prevent passage of unwanted hydrocarbon fluids therethrough, whereby the collector is substantially enclosed about the oil well drilling means. Further, is some embodiments the relief passage and the drilling port are coincidental.

Also, in preferred embodiments the collector is substantially sealed to the ocean bottom about the wellhead, whereby the ocean bottom and the upper portion of the collector element define a fixed enclosed volume, and the seal is adapted to prevent passage of liquid therethrough into the fixed, enclosed volume; and the collector is adapted to allow completion of the seabottom wellhead for production of hydrocarbon fluids with the collector fixably attached about the wellhead.

According to another aspect of the invention, a seabottom wellhead for underwater drilling and hydrocarbon production includes well drilling means, a subsurface oil blow-out collector apparatus adapted for well drilling therethrough, and fixably attached to the ocean floor about the wellhead, the apparatus comprising a collector element having an extended, open base and an upper portion enclosing a volume to receive fluid comprising substantial quantities of gas and lesser quantities of oil rising, in the water, from the wellhead, and a conduit defining riser connected to the collector element and extending thereabove to conduct the fluid therefrom, whereby the wellhead is adapted for oil well drilling and the wellhead is also adapted for containment of hydrocarbon fluids escaping from any blow out that may occur.

A further aspect of the invention relates to a method of collecting oil from a blown-out seabottom wellhead. According this further aspect, the method includes providing a collector apparatus with a relief passage from the interior of the collector apparatus to the exterior to vent excess gas from the apparatus during initial stages of any blow-out, providing a drilling port through the collector apparatus to permit drilling operation to proceed with the collector apparatus positioned over the wellhead, fixably attaching the collector apparatus to the ocean floor about the seabottom wellhead prior to any blowout, allowing, in the event of a blowout, the substantial excess volumes of gas that inherently flow from a blown-out well to escape from the collector apparatus by means of the relief passage, and collecting oil conducted from the collector through the conduit-defining riser by gas lift pumping.

In preferred embodiments, the method includes providing a valve in the relief passage, leaving the valved relief passage open during drilling and during initial stages of any blow out to allow escape of the substantial excess volumes of gas, and closing the valved passage after gas lift pumping of oil is established through the riser by flowing gas thereby limiting escape of released hydrocarbon fluids from the collector apparatus and reducing the amount of water carried in the riser by the gas flow; and sealing the collector apparatus to the ocean bottom about the wellhead.

The invention thus provides a passive, in place apparatus that allows oil well drilling to proceed unimpeded during normal drilling conditions, but that provides almost immediate marine pollution protection in the event of a uncontrolled eruption to contain escaping hydrocarbon fluids and conduct them away from the blow out under controlled conditions. The invention further provides a means for safely collecting escaping hydrocarbon fluids in critical or hazardous environmental conditions where other procedures would not be effective or safe.

This defensive installation is of particular importance where immediate protection against petroleum pollution is desirable, e.g. in environmentally critical areas, such as George's Bank fishing grounds, or where quick recovery action would be difficult or dangerous, such as in the Arctic.

These and other objects and features of the invention will be understood from the following description of a preferred embodiment.

PREFERRED EMBODIMENT

The structure and operation of a preferred embodiment of the invention will now be described, after first briefly describing the drawings.

DRAWINGS

Figure 7:
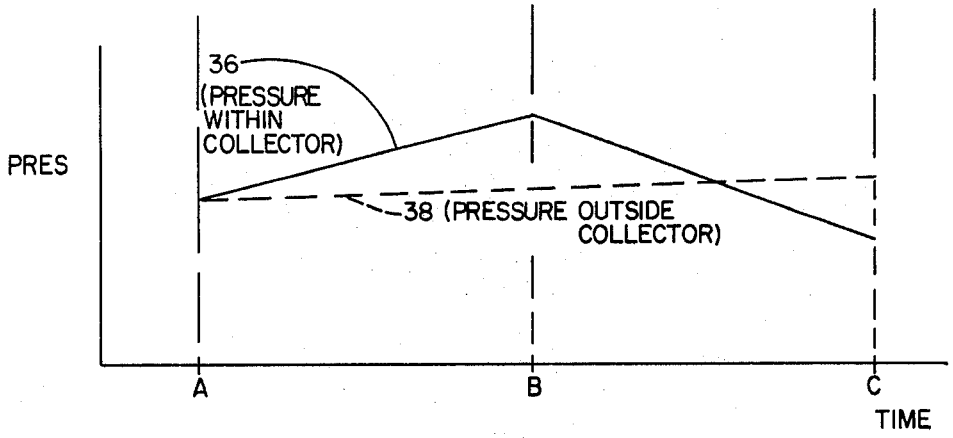
Figure 6A:
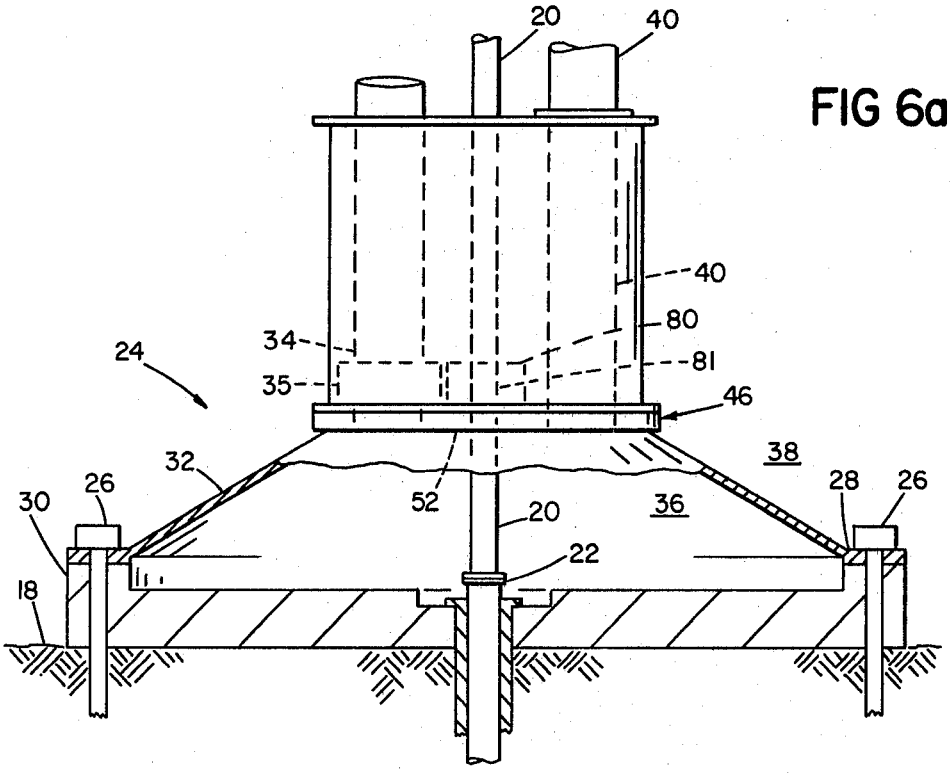
Figure 6B:
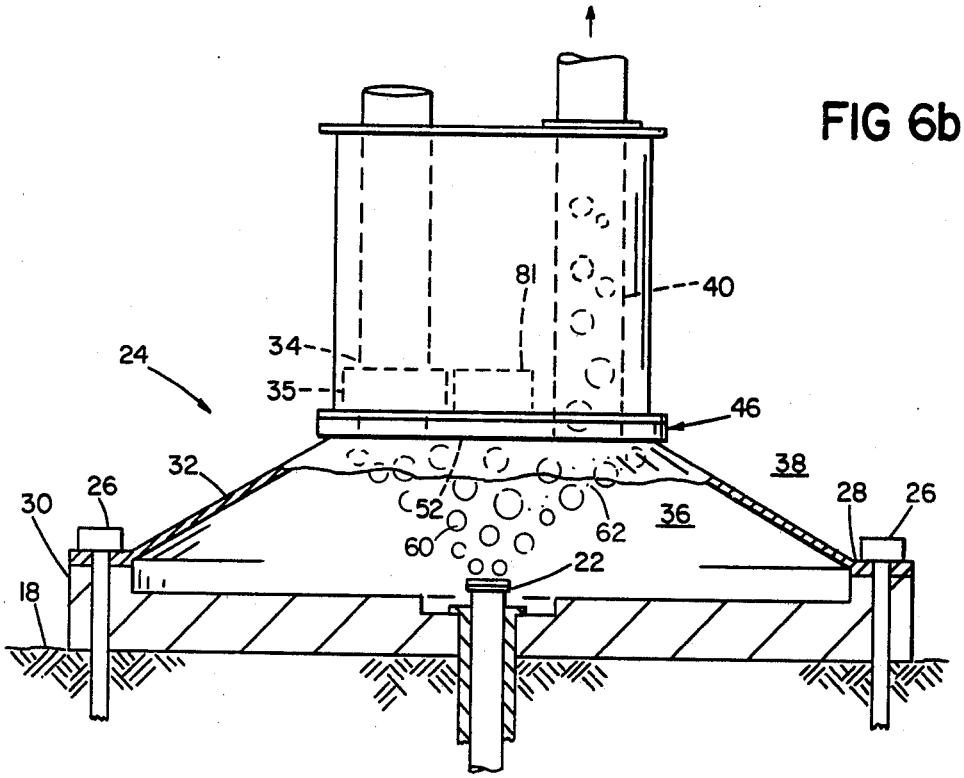

FIG. 6*a* is a side view, partially in section of a collector apparatus showing another embodiment of the drilling port during normal drilling operation, while FIG. 6*b* is a similar view of the apparatus in FIG. 6*a* in operation over a blown-out well; and FIG. 7 is a comparitive graph of collector internal pressure versus external pressure over time.

STRUCTURE

Figure 1:
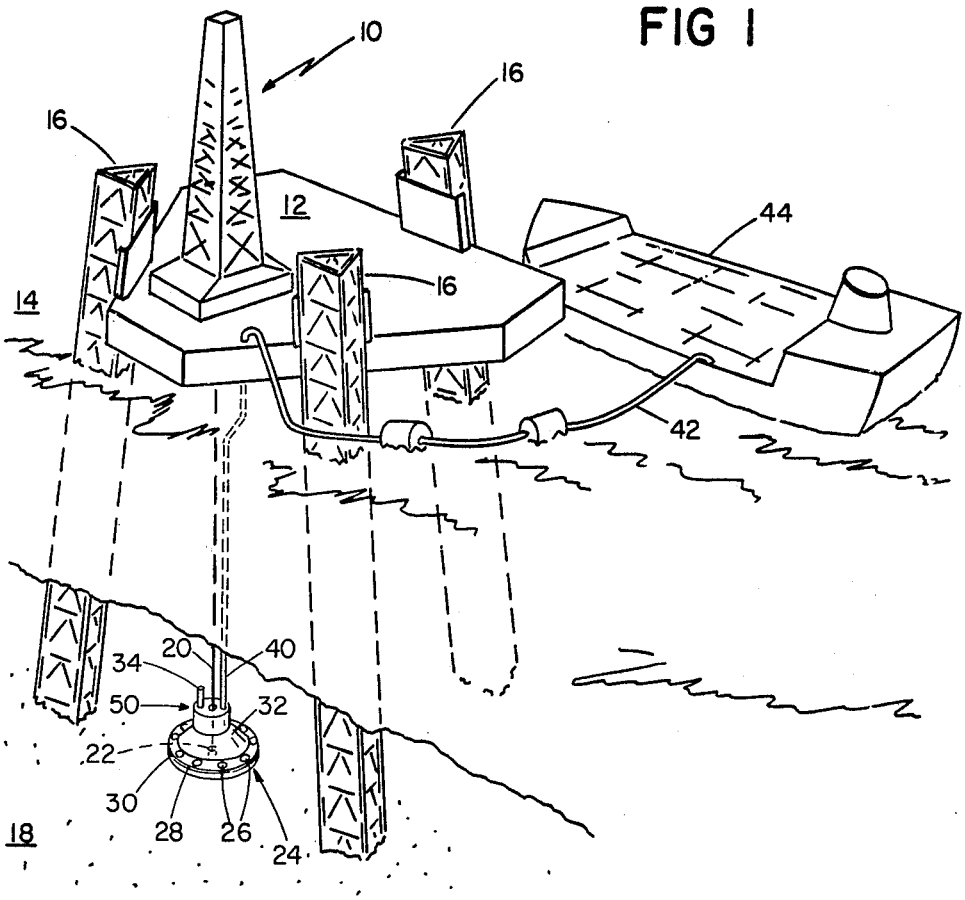
FIG. 1 is an isometric side view of a subsea oil well drilling operation employing the collector apparatus of the invention.

Referring to FIG. 1, an apparatus 10 for drilling subsea wells to recover petroleum, e.g. gas or oil, is shown. Jack-up platform 12, typically 60 meters (195 feet) across, is supported above the water surface 14 on trusses 16, typically 6 meters (20 feet) across, used in tripod configuration, reaching to the ocean floor 18 where drilling is taking place. The drill string 20 extends from platform 12 to the subsea wellhead 22 on the ocean floor 18. Surrounding the wellhead is cone shaped collector 24, typically 9 meters (30 feet) in diameter at the base with sides at a 30° angle to the horizontal, which is secured by piles 26 driven through skirt 28 to pad 30 to form a seal around the bottom rim of collector 24. The upper portion 32 of the collector 24 has opening 34 with valve 35, between the interior volume 36 of the collector 24 and the exterior 38, which is open during normal operation, but which may be closed after a blow out occurs. The interior 36 of the collector 24 is also connected to the surface 14 by means of marine riser 40, typically 0.75 meter (30 inches) in diameter, which is connected at its upper end 42 to an oil tanker 44 operating on the surface 14 of the ocean.

Figure 2:
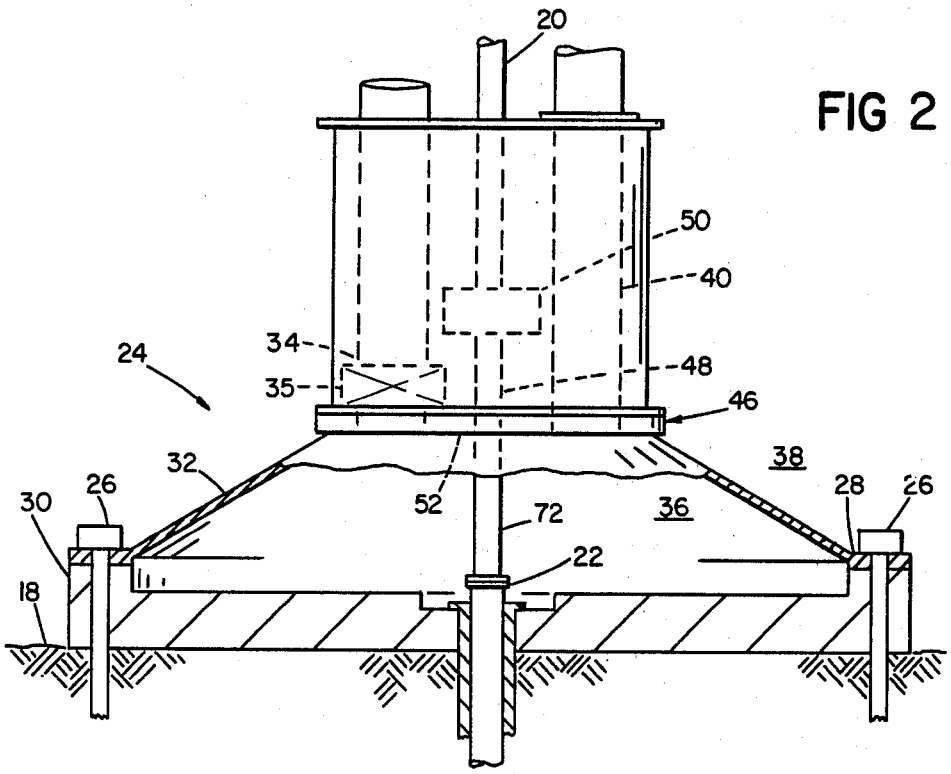
FIG. 2 is a side view partially in section of the collector apparatus in position about a subsea wellhead during normal drilling operation.

Referring now to FIG. 2, the drill string 20 passes through the top 46 of collector 24 to wellhead 22. This passage 48 is sealed against leakage by means of blow out protector stack 50, e.g. as shown in *A Primer of Oil Well Drilling,* Austin: Petroleum Extension Service, University of Texas (1957), at page 45.

OPERATION

Referring again to FIG. 1, jackup platform 12 is floated into position over a prospective drilling site. Trusses 16, typically three are employed, are established on the ocean floor and platform 12 is "jacked up" off the ocean surface (hence the name) to form a stable, drilling operation surface.

A level pad 30 is installed about the proposed wellhead 22 and collector 24 is attached to pad 30 by means of skirt piles 26. This forms a seal against leakage of sea water into the collector enclosure 36, except, of course, through other openings provided. Marine riser 40 is connected to the surface, typically to a small tanker 44. Drill string 20 is assembled and drilling is commenced at wellhead 22 with the drilling taking place through port 48 in collector 24 which is sealed against leakage, e.g. by means of blow out protector stack 50.

During normal drilling operations (FIG. 2) relief passage valve 35 in collector wall 52 is open and collector 24 and riser 40 are full of sea water. The pressure inside collector is substantially equal to the pressure outside (36, 38 respectively; A, FIG. 7).

Figure 3:
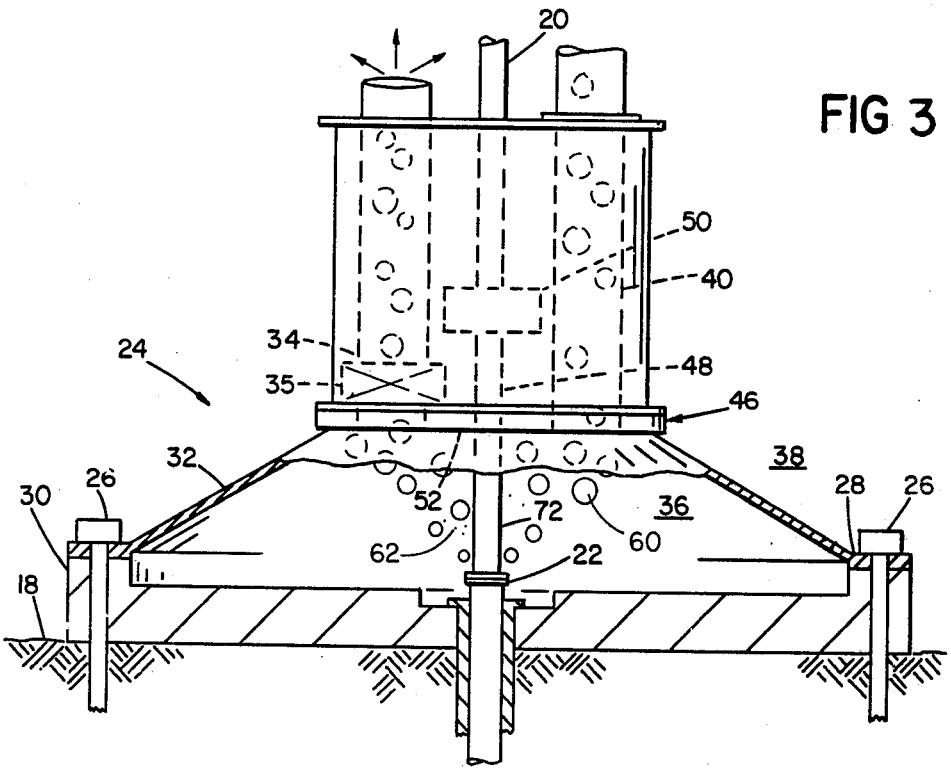
FIG. 3 is an similar view of the collector apparatus and wellhead of FIG. 2 during the initial stages of a well blow out.

If a blowout occurs (FIG. 3), wellhead 22 erupts violently with large quantities of gas 60 and some lesser quantities of oil 62. The escaping gas 60 fills the inside 36 of collector 24 and escapes via riser 40 and open relief passage valve 35. At this point (B, FIG. 7), pressure inside 36 collector 24 is higher than the outside 38 pressure, thereby urging collector 24 off the ocean floor, however the combination of the escape of gas through relief passage 34 and the attachment with the skirt piles 26 holds the collector 24 in place during these initial stages of blow out.

Figure 4:
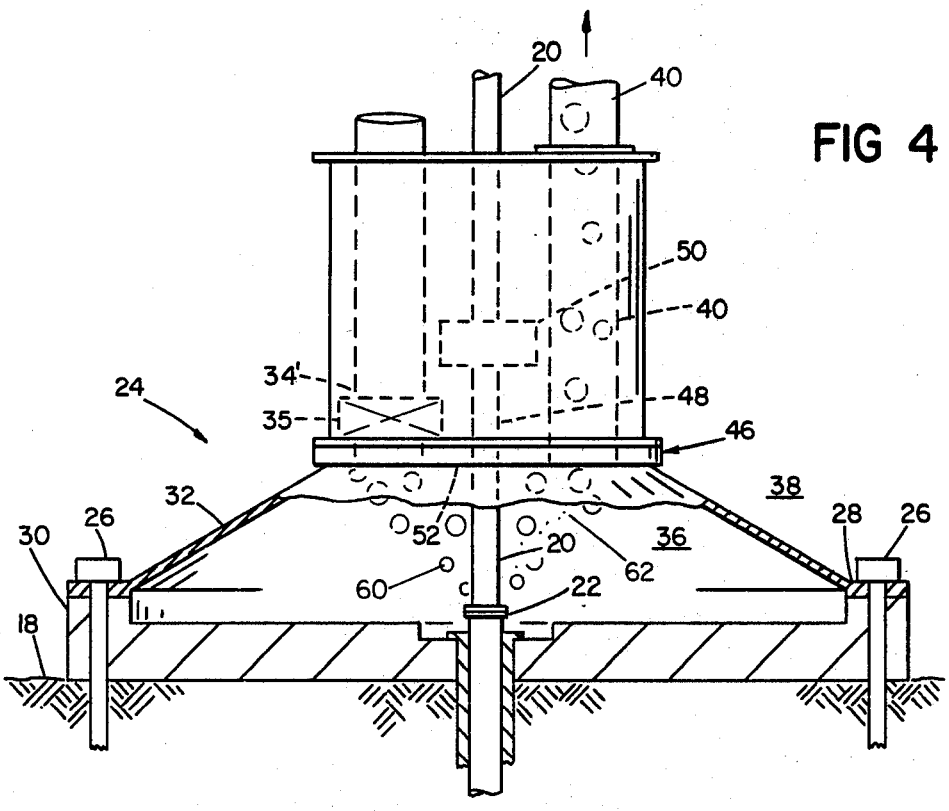
FIG. 4 is still another view of the collector apparatus and wellhead of FIGS. 2 and 3 showing the collector apparatus in gas lift pumping operation over the blown-out well.

As the blow out continues (FIG. 4), gas lift pumping becomes established in marine riser 40, i.e. the flow of gas from wellhead 22 through riser 40 to the surface 14 carries liquid (initially water with some oil) to the surface with it. When this gas lift pumping is established, relief passage valve 35 is closed to prevent further water from entering the collector 24, and only gas and oil rise to the surface through riser 40. This is essentially a producing well, except it is relatively uncontrollable, with generally higher flow rates than seen at a standard, producing well.

Once gas-lift pumping is established in riser 40 (C, FIG. 7), the pressure inside 36 collector 24 drops to a value lower than that of the outside water 38. Riser 40 becomes partially filled with gas and a lower pressure drop occurs across the riser 40 than in the hydrostatic column of water outside the riser. Therefore, if a blowout occurs with gas, oil and water initially escaping through the relief valve 35, the relief valve can eventually be closed after gas-lift begins in riser 40 and the pressure inside 36 the collector 24 drops.

This unexpected pressure profile, i.e. where the pressure within the collector decreases after the initial eruption of gas to a level at which the collector is in fact held on the ocean bottom, shown in FIG. 7, in combination with the relief passage 34 which diminishes any pressure buildup within the collector during initial stages of any blow-out, facilitates use of a relatively lightly constructed device rather than the heavily braced device anticipated as required to withstand the pressures generated within the collector by the escaping gas.

Figure 5:
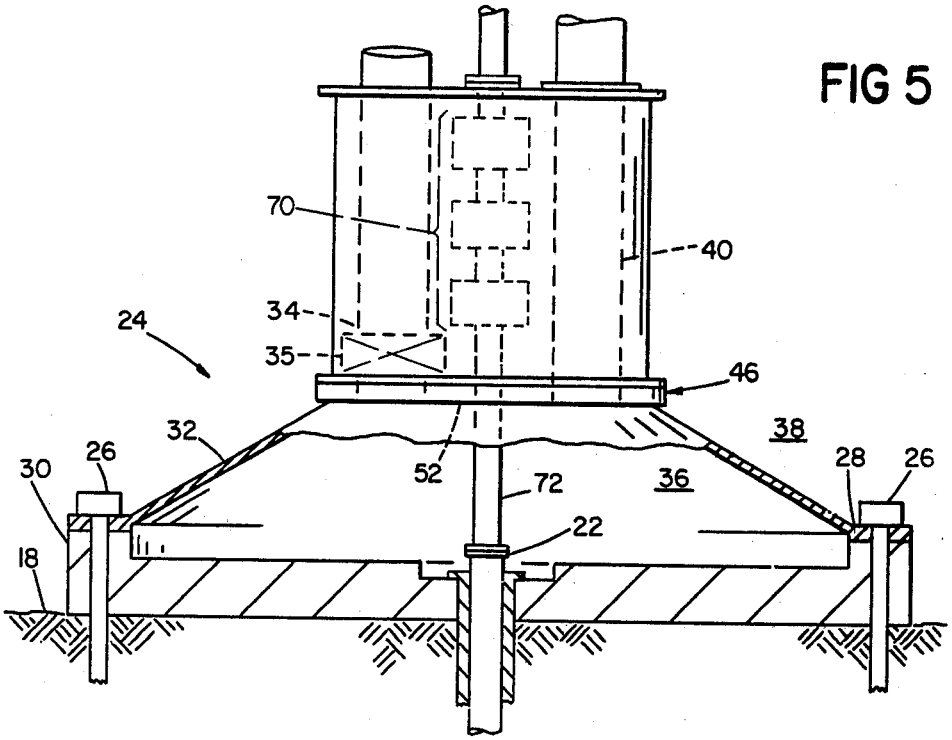
FIG. 5 is a side view partially in section of a subsea wellhead completed for normal pumping operation with the collector apparatus in position.

As shown in FIG. 5, if the well drilling proceeds normally without blow out, completion, i.e. assembling valves and fittings 70 at the top of a well for petroleum production, is completed on top of collector 24, with a section of casing 72, typically 25 cms (9 inches) in diameter or less, at the wellhead and 0.75 meter (30 inches) in diameter at the surface, extending from the seabed 18 to the top 46 of collector 24.

OTHER EMBODIMENTS

Other embodiments of the invention are within the following claims. For example, as shown in FIGS. 6*a* and 6*b*, drilling may proceed on wellhead 22 within collector 24 by passing through port 80 fitted with valve 81, which may remain open during drilling operation (FIG. 6*a*). If a blow-out occurs (FIG. 6*b*), drill string 20 would be broken off, and withdrawn from collector port 80, after which valve 81 could be closed. Prior to closing valve 81, port 80 would also serve as a relief passage for the excess volume of escaping gas. Also, if the seal between the skirt 28 of collector 24 fails during gas lift operation the entering water will be pumped to the surface with the gas and oil where a separator apparatus, as known in the industry, may be employed. If leakage does occur, the water may enter at high velocity (due to the pressure differential (C, FIG. 7)) causing localized scouring of ocean floor to introduce undesirable sand, etc. into the riser flow. In this case, relief valve 35 may be partially opened to allow more water to enter to decrease the difference in pressure and eliminate scouring. Also, the seal between the ocean floor and the collector apparatus may be provided by installing a collector element with a vertically extending flange at the base which is driven into the ocean bottom by the pressure reversal seen when gas lift pumping is established.

I claim:

1. In a collector apparatus for recovery of the effluent from a blown-out seabottom wellhead, said apparatus comprising a collector element having an extended, open base and an upper portion to receive a flow of substantial quantities of gas and lesser quantities of oil that rise together from said seabottom wellhead, and a riser conduit connected to said collector element and extending thereabove to conduct said fluid therefrom, said upper portion of said collector element further including a valved relief passage means from its interior to the exterior of said collector element, the improvement wherein said collector element is adapted for fixable attachment to the ocean floor prior to any blow-out to define an enclosed fluid volume, said fluid volume being sized and shaped to prevent separation of the mixture of gas and oil before reaching said riser conduit, the base of said collector element defines an annular sealing band of significant width selected to provide substantial sealing contact with the ocean bottom about said wellhead to prevent passage of fluid therebetween, said riser conduit is rigid and adapted to conduct the mixture of oil and gas from the interior of said element by gas lift pumping in which oil in the mixture is carried upwardly by the effects of gas in the mixture, said valved passage is adapted to be adjusted, after gas-lift pumping of oil is established through said riser, to control the pressure differential between the enclosed volume of the collector element and the surrounding ocean to prevent pressure variation that can result in: localized scouring of the ocean bottom surrounding said wellhead; escape of released oil from said collector element; and introduction of water into said element thence into said riser, and said collector element includes drilling port means to permit passage therethrough of a well drill to allow well drilling operations through said collector apparatus while said collector is in place upon said seabottom.

2. The apparatus of claim 1 characterized in that said drilling port means is valved whereby said valved drilling port means is adapted to remain open while the drill string is in place and is adapted to be closed when the drill string is removed, as during a blow out, to prevent escape of excess gas or oil.

3. The apparatus of claim 1 characterized in that said drilling port means is adapted to prevent passage of unwanted hydrocarbon fluids therethrough, whereby said collector is substantially enclosed about said oil well drilling means.

4. The apparatus of claim 1 wherein said drilling port means comprises a relief passage means.

5. The apparatus of claim 1 wherein said annular band is disposed radially about the open base of said collector element for surface-to-surface sealing contact with said ocean bottom about said wellhead.

6. The apparatus of claim 1 wherein said annular band is disposed axially downward about the open base of said collector element, said band being adapted for penetration of the ocean bottom about said wellhead for said sealing contact.

7. In a method of recovering the effluent from a blown-out seabottom wellhead, said method including positioning a collector element over said wellhead, said collector element having an extended, open base and an upper portion to receive a flow comprising substantial quantities of gas and lesser quantities of oil that rise together from said seabottom wellhead, and a riser conduit connected to said collector element and extending thereabove to conduct said fluid therefrom, said upper portion of said collector element further including a valved relief passage means from its interior to the exterior of said collector element, the improvement comprising fixably attaching said collector element to the ocean floor on the seabottom prior to any blow-out to define an enclosed fluid volume, said fluid volume being sized and shaped to prevent separation of the mixture of gas and oil before reaching said riser conduit, providing substantial sealing contact between the base of said collector element and the ocean bottom about said wellhead to prevent passage of fluid therebetween, conducting said mixture of oil and gas from the interior of said element to said riser conduit by gas lift pumping in which oil in the mixture is carried upwardly by the effects of gas in the mixture, adjusting said valved passage after gas-lift pumping of oil is established through said riser thereby controlling the pressure differential between the enclosed volume of the collector element and the surrounding ocean to prevent pressure variation that can result in: localized scouring of the ocean bottom surrounding said wellhead; escape of released oil from said collector element; and introduction of water into said element thence into said riser, and allowing well drilling operations through said collector apparatus while said collector is in place upon said seabottom.

* * * * *